US005673503A

United States Patent [19]

Rendleman

[11] Patent Number: 5,673,503

[45] Date of Patent: Oct. 7, 1997

[54] GAMING CHIP WITH EDGE INSERT AND PROCESS FOR FABRICATING SAME

[75] Inventor: Thomas G. Rendleman, Olathe, Kans.

[73] Assignee: Trend Plastics Inc., Olathe, Kans.

[21] Appl. No.: 569,908

[22] Filed: Dec. 8, 1995

[51] Int. Cl.[6] ..... G09F 3/02

[52] U.S. Cl. ..... 40/27.5; 264/273; 264/274

[58] Field of Search ..... 40/27.5; 264/247, 264/263, 273, 274

[56] References Cited

U.S. PATENT DOCUMENTS

| | | | |
|---|---|---|---|
| 695,153 | 3/1902 | Hoyt | 273/58 R |
| 2,288,187 | 6/1942 | Gits et al. | 264/274 X |
| 2,609,570 | 9/1952 | Danielson et al. | 264/247 X |
| 2,720,681 | 10/1955 | Danielson et al. | 264/247 |
| 3,302,242 | 2/1967 | Morin | 264/247 X |
| 3,354,249 | 11/1967 | Morin | 264/247 |
| 3,522,345 | 7/1970 | Olsen | 264/273 |
| 3,968,582 | 7/1976 | Jones | 40/27.5 |
| 4,387,070 | 6/1983 | Cunard et al. | 264/247 |
| 4,435,911 | 3/1984 | Jones | 40/27.5 |
| 4,624,815 | 11/1986 | Moufarrege | 264/247 X |
| 5,032,197 | 7/1991 | Trimble | 264/274 X |
| 5,094,922 | 3/1992 | Ielpo et al. | 40/27.5 X |
| 5,166,502 | 11/1992 | Rendleman et al. | 235/492 |
| 5,567,362 | 10/1996 | Grun | 264/273 X |

*Primary Examiner*—Kenneth J. Dorner
*Assistant Examiner*—Andrea Chop
*Attorney, Agent, or Firm*—Kokjer, Kircher, Bowman & Johnson

[57] ABSTRACT

A gaming chip having an edge insert, and a gaming chip fabrication process, the edge insert having an opening for receiving molding compound. A gaming chip has a core element, such as a substantially flat ring or disc. A plastic edge insert, having a face with an opening therein, is positioned at the edge of the core element. Molding compound, of a color different that the plastic edge insert, is formed around the core element and within the opening of the plastic edge insert to thereby create a complex, interesting, or distinctive visual appearance at the edge of the gaming chip. Multiple embodiments for releasably orienting the edge insert on the core element, prior to forming molding compound about the core element, are provided. In a preferred embodiment, the gaming chip has multiple plastic edge inserts positioned at equally spaced intervals about the gaming chip.

19 Claims, 2 Drawing Sheets

GAMING CHIP WITH EDGE INSERT AND PROCESS FOR FABRICATING SAME

BACKGROUND OF THE INVENTION

1. Field of the Invention

This invention relates generally to gaming chips or tokens and a process for fabricating same. More specifically, this invention is directed to a fabricating process and the resulting unique gaming chip which provide a gaming chip, having a unique exterior, which is difficult to counterfeit.

2. Description of the Related Art

Gaming chips of various denominational values are commonly used in games of chance. Different color schemes and design characteristics are used in accordance with different denominational chip values and casino designation. The different visual patterns on the gaming chips serve important purposes, such as permitting casino operators, employees, and game players to readily discern chip values. Perhaps more importantly, it is necessary that the visual characteristics of a gaming chip are both permanent and complex enough so as to avoid counterfeiting. Toward this end, several common methods of forming a gaming chip with definite designs on its outer surface presently exist.

One conventional method of fabricating gaming chips utilizes a discoid having projections which may represent a particular casino's logo and the denominational value of the token. A molding compound is formed over the discoid while allowing the projecting indicia to extend to the outer edge of the discoid.

Another known method of fabricating gaming chips is disclosed in U.S. Pat. No. 3,968,582 (Jones). This method utilizes two rings having offsets and indentations in an aligned manner to form one interlocking embodiment. A molding compound is supplied to the embodiment and metal coins are received within a central opening.

The gaming chips which result from the known manufacturing techniques (including the above) have several disadvantages. Notably, each is capable of being counterfeited, although perhaps with some difficulty. In an effort to further deter or prevent counterfeiting, one conventional method for making gaming chips utilizes a molding compound which is compressed into a discoidal ring. Various color combinations may be employed and colored inserts are placed in grooves along the outer periphery of the ring. Additional molding compound is then formed about the ring. The arrangement of colored inserts along the periphery of the gaming chip provides a distinctive and difficult-to-counterfeit visual appearance. However, the colored inserts themselves do not provide the ability to display complex detail, such as logos, numbers, letters, etc., at the periphery of the gaming chip.

In summary, prior art gaming chips and gaming chip fabrication techniques do not permit development of a complex design on or near the peripheral edge of the gaming chip. Moreover, development of such a complex ornamental visual appearance at the peripheral edge surface of a gaming chip would seemingly be accomplished only at great expense and complication, primarily due to the space limitations on the edge of a gaming chip.

Accordingly, the need exists for an inexpensive gaming chip which is extremely difficult to counterfeit, particularly in view of the increasingly advanced techniques being employed by unscrupulous counterfeiters. Specifically, the need exists for a gaming chip having unique, and difficult to counterfeit, visual characteristics on or proximate the outer peripheral edge of the gaming chip. Such visual characteristics would provide highly distinguishable gaming chips and serve to readily identify information relative to the chip, such as casino designation, and/or chip value. Additionally, gaming chips having precise and complex designs on their peripheral edge are desirable simply for their uniqueness. The present invention overcomes the limitations of the prior art, and fills the foregoing and other needs.

SUMMARY OF THE INVENTION

It is an object of the present invention to provide a gaming chip which is difficult to counterfeit.

It is an object of the present invention to provide a gaming chip having a complex peripheral edge surface.

It is an object of the present invention to provide a gaming chip fabrication process which produces an inexpensive, yet visually sophisticated gaming chip.

It is a further object of the present invention to provide a gaming chip having a core member surrounded with molding compound and at least one edge insert having an opening therein in which molding compound is also formed.

It is a principle object of the gaming chip and fabrication process of this invention to provide a gaming chip having a multi-colored peripheral edge including designs, logos, lettering, or indicia.

These and other objects are achieved by an improved gaming chip and a unique gaming chip fabrication process. The gaming chip of the present invention has a core element, such as a discoid or ring, preferably made of plastic. One of more locations along the outer peripheral edge of the core element provide connectors for mating with and releasably engaging a separately formed plastic insert. The plastic insert has an outer face having one or more openings formed therethrough. The openings preferably form an ornamental visual characteristic, indicia, or other identifier.

Molding compound is formed over the core element during the process of fabricating the gaming chip. During the fabrication process, molding compound, in liquid form, seeps over or around the connectors on the core element and into a location behind the outer face of the plastic edge insert. Furthermore, the molding compound, preferably of a color different than the core element and the plastic edge insert, seeps through the opening(s) in the outer face of the plastic edge insert. When the molding compound cures, it fixedly secures the plastic edge insert onto the core element and into the cured molding compound. Importantly, the molding compound also fills the void created by the opening (s) in the plastic edge insert, to thereby create a distinctive visual appearance on the outer periphery of the gaming chip.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
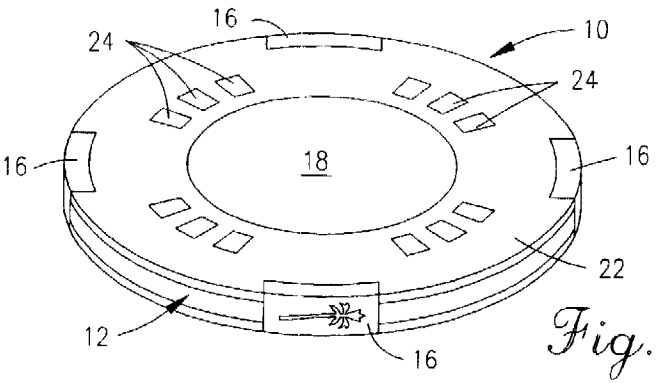
FIG. 1 is a perspective view of a completed gaming chip of the present invention.
Figure 2:
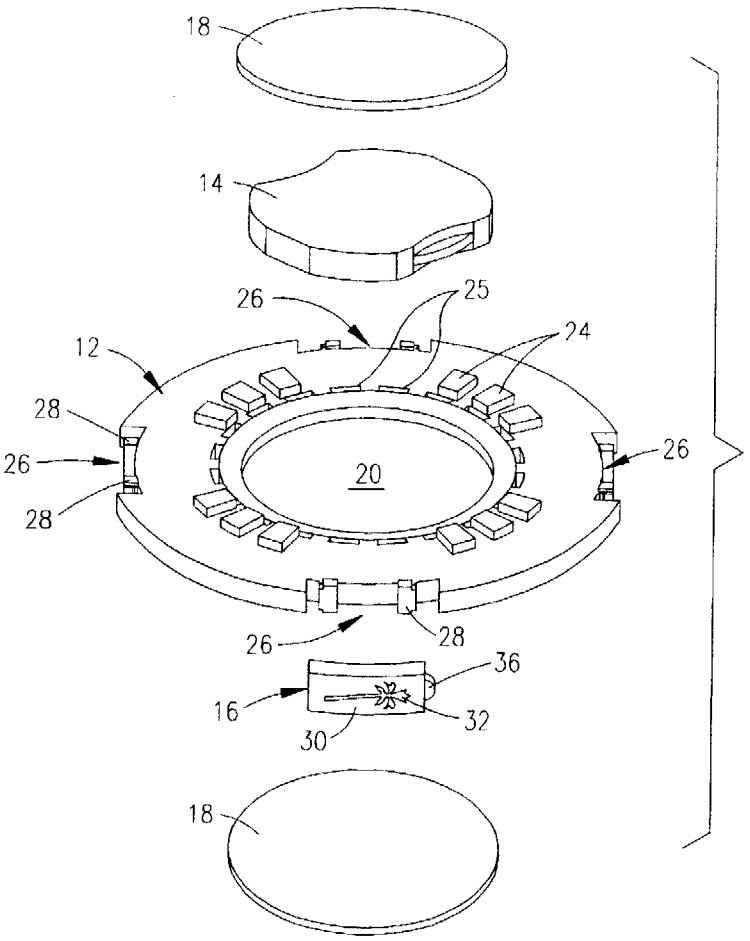
FIG. 2 is an exploded perspective view of the components of the gaming chip of the present invention.

With reference initially to FIGS. 1 and 2, a gaming chip in accordance with the present invention is denoted generally by reference numeral 10. Gaming chip 10 is comprised, in a preferred embodiment, of a ring 12, a central coin 14, a plurality of edge inserts 16, and labels 18.

Specifically, gaming chip 10 is preferably formed of a colored molding compound 22 which surrounds and is contiguous to a plastic ring (or discoid) 12. Plastic ring 12, which is preferably of a different color than the molding compound 22, has raised projections 24 extending from its facial surfaces. As shown in FIG. 1, raised projections 24 extend to the outer surfaces of gaming chip 10 so as to become a visual characteristic on the exterior of the gaming chip. Projections 24, desirably having a color scheme distinguishable from molding compound 22, are in the form of a preferred design which may include, among other things, a particular casino's identifying indicia (or logo) and a denominational value. As shown, ring 12 also has a plurality of channels 25 extending between faces of ring 12 and spaced about the periphery of aperture 20 within the center of ring 12. During the process of fabricating gaming chip 10, molding compound 22 flows through channels 25, to thereby create a strongly bonded chip 10.

Plastic ring 12 has indented or recessed areas, denoted generally by reference numeral 26, at its outer peripheral edge. Although any reasonable or desired number of indented areas 26 may be present on ring 12, ring 12 preferably has four such indented areas 26 spaced about ring 12 at 90° intervals. Each indented area 26 has a pair of spaced-apart mounting post members 28 extending outwardly from the edge of ring 12, as shown. As described in greater detail below, post members 28 are adapted to mate with and releasably engage a plastic insert 16.

Figure 3:
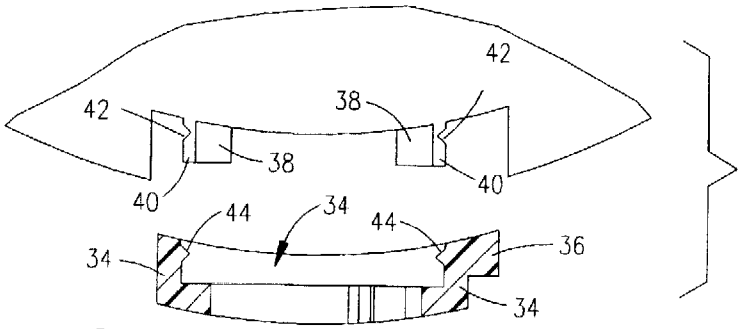
FIG. 3 is an enlarged cross-sectional plan view of an edge insert and mounting arrangement utilized in accordance with a gaming chip of the present invention.
Figure 4:
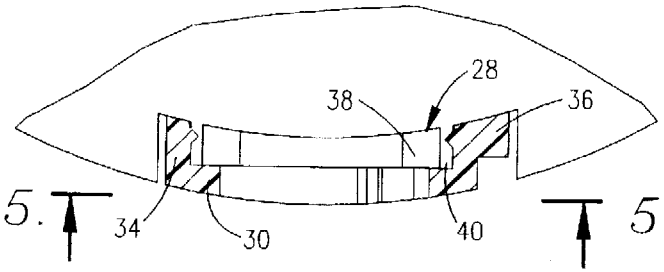
FIG. 4 is a plan view, with an edge insert of the present invention shown in cross-section, the edge insert being releasably connected to the periphery of a ring or discoid of a gaming chip.

With additional reference to FIGS. 3 and 4, a plastic edge insert 16 and mounting posts 28 are shown and described in detail. Edge insert 16, like ring 12, is preferably formed of plastic and preformed prior to constructing gaming chip 10. Edge insert 16 has a curved outer face 30 having an arcuate configuration which conforms to the dimensions of the periphery of ring 12 such that, when gaming chip 10 is fabricated, outer face 30 is flush, and in alignment, with the outer peripheral edge of gaming chip 10, as shown in FIG. 1. Edge insert 16 preferably has wall portions 34 extending from the peripheral edge of outer face 30, as shown. The formation of plastic edge insert 16 thus provides a cavity, behind outer face 30 and between wall portions 34. At least one of wall portions 34 also has an integral tab 36 formed therewith.

In accordance with a key aspect of the present invention, edge insert 16 has at least one opening 32 formed through its outer face 30. As shown in the figures, opening 32 appears as a leaf having a stem. It should be understood that one or more opening(s) 32 may be formed in face 30 of edge insert 16, and that the opening(s) 32 may comprise any desired configuration. For example, opening(s) 32, in addition to being any desired ornamental configuration, may be a desired logo, lettering, numbers, or other indicia, such as a casino logo or name or a token value, or any combination thereof. Additionally, although the opening 32 is illustrated as being within the confines of the outer edges of face 30 of plastic edge insert 16, it should be understood that opening (s) 32 may extend to one or more edges of face 30 of plastic insert 16.

During the process of fabricating gaming chip 10, thermoplastic molding compound 22 is introduced into the cavity formed by plastic edge insert 16. As described in greater detail below, molding compound 22 also flows into the space formed by opening(s) 32 in face 30 of insert 16.

Each mounting post 28 preferably has a first major portion 38 which, as best shown in FIG. 2, extends beyond the outer faces of ring 12. In the principle embodiment shown in FIGS. 1–6, mounting posts 28 are dimensioned to extend outwardly from indented area 26, but not to extend outwardly as far as the outer peripheral edge of plastic ring 12. In this way, when plastic edge insert 16 is positioned onto mounting posts 28, the outer face 30 of insert 16 is substantially aligned with the outer peripheral edge of plastic ring 12.

Figures 5, 6, 7, 8, 9, 10, 11:
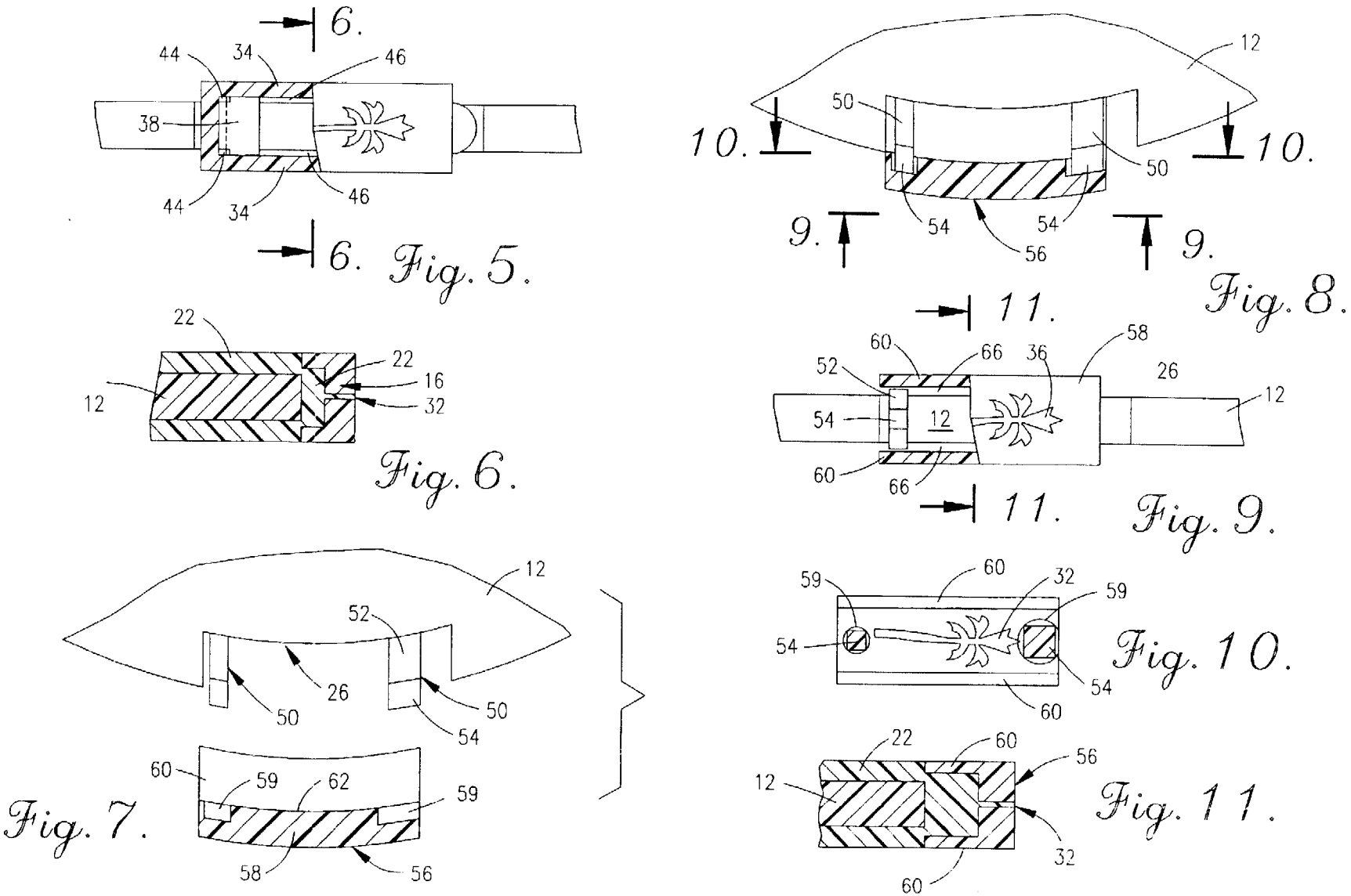
FIG. 5 is an enlarged elevational view, taken along line 5—5 of FIG. 4, showing the edge insert with a portion broken away and illustrated in cross-section.
FIG. 6 is a cross-sectional view taken along line 6—6 of FIG. 5.
FIG. 7 is an enlarged cross-sectional plan view of an edge insert and mounting arrangement utilized in accordance with a gaming chip of an alternate embodiment of the present invention.
FIG. 8 is a plan view, with an edge insert of the embodiment of FIG. 5 shown in cross-section, the edge insert being releasably connected to the periphery of a ring or discoid of the gaming chip.
FIG. 9 is an enlarged elevational view, taken along line 9—9 of FIG. 8, showing the edge insert with a portion broken away and illustrated in cross-section.
FIG. 10 a plan view of an edge insert of the present invention taken along line 10—10 of FIG. 8.
FIG. 11 is a cross-sectional view of the present invention, taken along line 11—11 of FIG. 9.

Each mounting post 28 also has a minor portion 40 having a notch 42 therein. Each mounting post 28 preferably has a notch 42 positioned at a side of the mounting post 28 proximate an outer edge of the indented area 26 in which the mounting post 28 resides. As shown in FIG. 3, each of those wall portions 34 of edge insert 16 defining an end wall has a projecting rib 44 extending inwardly towards the center of the cavity formed by insert 16. It will be appreciated that ribs 44 are designed to mate with notches 42 in mounting posts 28. As shown in FIG. 5, plastic edge insert 16 is positioned onto mounting posts 28 such that ribs 44 are received by, and mate with, notches 42 of the mounting posts 28. It should be understood that wall portions 34, and particularly those wall portions 34 defining end walls of plastic edge insert 16 are resiliently flexible, and thus may be bent slightly outwardly to permit mounting posts 28 to be received within the cavity formed by insert 16. As the plastic edge insert 16 is slid into place onto mounting posts 28, the ribs 44 will snap-fit into notches 42. As a result, plastic edge insert 16 is releasably engaged with mounting posts 28 of plastic ring 12, as shown in FIG. 4.

Plastic insert 16 has a tab 36 integrally formed with one side-wall portion 34 thereof. Additionally, one mounting post 28 of each pair of mounting posts 28 within an indented area 26 is closer to an edge of indented area 26 than the other mounting post. This is best illustrated in FIGS. 3 and 4. Edge insert 16 is constructed such that tab 36 locates in the indented area 16 between one side edge of indented area 16 and that mounting post 28 which is more greatly removed from the side edge of indented area 16. Such a construction permits inserts 16 to be quickly and properly oriented onto plastic ring 12, since an insert 16 will properly mount on the mounting posts 28 in only one manner. During fabrication of gaming chip 10, molding compound 22 is formed over tab 36 to assist in locking the insert onto the ring 12.

FIG. 5, taken along line 5—5 of FIG. 4, illustrates major portion 38 of mounting post 28 extending beyond the plane of each face of plastic ring 12. Particularly, major portion 38, mounting post 28, and edge insert 16 are dimensioned such that the upper and lower surfaces of major portion 38 of mounting post 28 snugly engage the interior surface of wall portions 34 defining side walls of plastic edge insert 16. Thus, plastic edge insert 16 is releasably held in place during the fabrication process of gaming chip 10 by the frictional relationship between major portion 38 of each mounting post 28 and the wall portions 34 of edge insert 16, in addition to the rib/notch relationship previously described.

As a result of the foregoing described configuration and structure of plastic edge insert 16 and mounting posts 28, gaps 46 are provided between plastic edge insert 16 and plastic ring 12. As shown in FIG. 5, gaps 46 are provided not only above and below plastic ring 12 as oriented in FIG. 5, but also at each side of major portion 38 of the mounting posts 28. The spacing (e.g., gaps 46) between ring 12 and insert 16 are important to the construction of gaming chip 10 because molding compound 22 flows through gaps 46 during fabrication of the chip 10. Gaps 46 are thin slots which are quite small. While gaps 46 may be any suitable size to allow molding compound 22 to flow therethrough, it will be appreciated by those with skill in the molding arts that liquid molding compound 22 has no difficulty in seeping through small openings, especially when subjected to high pressures utilized with conventional molding techniques.

As shown in FIG. 6, molding compound 22 is formed about plastic ring 12, in gaps 46, about major portion 38 of each mounting post 28, and in the cavity behind outer face 30 of insert 16. Additionally, and in accordance with an important aspect of the present invention, molding compound 22 is formed in opening(s) 32 in face 30. As stated, the color of molding compound 22 preferably differs from the color of plastic edge insert 16, thereby defining a unique visual characteristic on the edge surface of the gaming chip 10, as shown in completed form in FIG. 1.

The process for fabricating gaming chip 10 should be readily understood in view of the foregoing description. Specifically, plastic ring 12 and plastic edge insert 16 are formed of plastic using conventional molding techniques. Edge inserts 16 are releasably engaged onto mounting posts 28. Metal coin 14 is placed in central aperture 20 of ring 12. Ring 12, with insert 16 thereon and coin 14 within its central aperture 20, is placed into a mold. Liquid molding compound 22 is introduced into the mold and forms about, and contiguous with, ring 12. U.S. Pat. No. 5,166,502, incorporated herein by reference, teaches a gaming chip 10 and gaming chip fabrication process wherein a molding compound 22 is formed over an inner ring 12 to create a gaming chip 10.

It has been found that, as molding compound 22 seeps through gaps 46 between insert 16 and ring 12, insert 16 is forced outwardly, but is restricted within the confines of the mold. This occurrence is useful for causing the outer peripheral face 30 of edge insert 16 to be aligned with the outer peripheral edge of the finished gaming chip 10. Additionally, the molding compound 22 seeps into and fills opening(s) 32 in the edge insert 16. The confines of the mold prohibit molding compound 22 from seeping out of opening(s) 32. In accordance with the preferred principles of the present invention, molding compound 22 is of a first color, plastic ring 12 is fabricated of a second color, and each of plastic edge insert 16 is fabricated of one or more additional colors. Preferably, fluorescent is added to the thermoplastic molding compound used to form plastic edge inserts 16. Thus, plastic edge insert 16 exhibit fluorescent characteristics, particularly when subjected to ultraviolet light. The addition of fluorescent in plastic edge inserts 16 increases the complexity of the chip, enhances the ornamentation of the gaming chip, and, particularly, makes the gaming chip 10 even more difficult to counterfeit. As a result, gaming chip 10 comprises a multi-colored gaming chip 10 with a multi-colored peripheral edge. Moreover, insertion of molding compound 22 into opening(s) 32 in insert 16 provides a highly distinctive ornamental characteristic on the peripheral edge of gaming chip 10.

To complete the fabrication process, labels 18, preferably having indicia imprinted thereon, are adhesively secured onto gaming chip 10 to complete gaming chip 10. Alternatively, labels 18 may be placed on opposite sides of coin 14 prior to the molding process. It should also be understood that coin 14 need not be used, in which case aperture 20 is filled with molding compound 22. Alternatively, plastic ring 12 may be a discoid which does not have a central aperture. Thus, it will be readily appreciated that plastic ring (or discoid) 12 is a core element which may be constructed in any suitable manner, and need not necessarily be substantially round as shown. In this regard, other suitable or desired shapes may be utilized in the construction of core member 12 and gaming chip 10.

As indicated, plastic ring 12 can be fabricated to accept any suitable number of plastic edge inserts 16. In this regard, a plurality of plastic edge inserts 16, each having an opening 32 defining a different visual characteristic, may be placed about ring 12 to increase the complexity of gaming chip 10. Additionally, in accordance with a preferred aspect of the present invention, where opening(s) 32 is of a configuration that is not symmetrical, such as lettering, it is preferred that the inserts are alternately oriented about gaming chip 10 such that a first set of inserts 16 are easily readable when the chip is resting on one surface, while the remaining inserts 16 are easily readable when the chip is resting on its opposite surface.

Turning now to FIGS. 7–11, an alternate embodiment of the gaming chip 10 of the present invention is shown and described.

As shown in FIG. 7, mounting posts 50 are positioned within an indented area 26 on a ring or discoid 12. In this embodiment, however, the mounting posts 50 within indented area 26 are sized differently, with one of the mounting posts 50 having a greater cross-sectional area than the other mount post 50. With additional reference to FIG. 9, each mounting post 50 is comprised of a base portion 52 and a head portion 54 extending outwardly from the base portion 52. Base portion 52 is dimensioned so as to extend beyond the facial surfaces of ring 12, as shown in FIG. 9. Additionally, mounting posts 50 extend outwardly beyond the outer peripheral edge of plastic ring 12, as shown in FIG. 7.

Plastic edge insert 56 has an outer face portion 58 and wall portions 60 extending from face portion 58 along at least major edges thereof. As shown in this embodiment, plastic edge insert 26 does not have end walls. The inner surface 62 of outer face 58 has a pair of recessed areas 59 adapted to receive mounting posts 50. With additional reference to FIG. 10, a view taken along line 10—10 of FIG. 8, it is illustrated that recessed areas 59 of face 58 of plastic edge insert 56 are circular in cross-section and have a circumference adapted to snugly engage the corners of head portion 54 of mounting posts 50. It will be appreciated that, with such an arrangement, plastic insert 56 is may be positioned onto mounting posts 50 in only one acceptable orientation.

As shown in FIG. 10, when plastic edge insert 56 is positioned onto mounting posts 50, plastic edge insert extends outwardly beyond the periphery of ring 12 due to the construction of mounting posts 50. However, during fabrication of the gaming chip 10, molding compound 22 is formed about ring 12 and contiguous with the outer side edges of insert 16, such that the outer surface 64 of face 56 forms an aligned part of the outer periphery of the gaming chip 10.

With reference to FIG. 9, the manner in which the construction of the mounting posts 50 provide gaps 66 between ring 12 and face 58 of insert 56 is illustrated. Face 56 has one or more opening(s) 32 of any desired shape therein. As illustrated in FIG. 11, molding compound 22 is formed, in the same manner as described above, about ring 12, within gaps 66, and within opening(s) 32, to thereby provide a gaming chip 10 with a uniquely designed outer peripheral edge.

It will be readily understood that the plastic edge inserts 16 utilized in accordance with this invention may be of any feasible size and configuration. Additionally, although alternate arrangements for positioning plastic edge inserts 16 onto the ring 12 are shown, it will be appreciated that numerous variations exist which will accomplish the purposes of the present invention. For example, only one mounting post may be provided for each insert, or more than two could be utilized. Alternatively, the plastic edge insert could have one or more male members for inserting into sockets or recessed areas 59 at the periphery of the ring 12. In another variation, portions of the major walls extending from the face of plastic edge insert may snugly engage the outer faces of ring 12, while leaving a gap through which molding compound 22 may flow. Further still, plastic edge inserts 16 and the periphery of ring 12 may be fabricated so that one or more mechanical bonds are made between the plastic edge insert and the ring. It will be appreciated by those skilled in the art that there are numerous ways to create a mechanical bond between the two parts, such as, for instance, having the two members hook together. In this regard, there are numerous ways in which a surface having one or more openings therein may be positioned near the outer edge of a core element, such that molding compound 22 is formed between the surface and the core element and within the openings of the surface.

Additionally, while the present invention has been described for illustrative purposes as having a face with an opening positioned along the edge surface of the gaming chip 10, it should be understood that additionally, or alternatively, one or both wall portions, such as wall portions 60 shown in FIG. 11 forming part of the exterior of the gaming chip 10, may have openings therethrough for receiving thermoplastic molding compound 22.

As described, the gaming chip 10 and fabrication process of the present gaming chip 10 utilizes a unique edge insert, having an opening therein, located at the edge of the gaming chip 10. The opening in the insert receives molding compound 22 that will be displayed, amidst the insert, at the exterior of the gaming chip 10. The gaming chip 10 of this invention thus has highly complex or interesting visual characteristics, making it visually appealing and distinctive, as well as difficult to counterfeit.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A gaming chip comprising:

a rigid core element having an outer peripheral edge;

at least one rigid insert element, formed separately from said rigid core element, said rigid insert element having a face with an opening therethrough, wherein said rigid insert element is positioned proximate said outer peripheral edge of said core element; and molding compound formed around said core element and within said opening in said face of said insert element, wherein said molding compound within said opening is visible at the exterior of said gaming chip.

2. The gaming chip as set forth in claim 1 wherein said face of said insert element is spacially removed from said outer peripheral edge of said core element, thereby leaving a gap between said face of said insert element and said outer peripheral edge of said core element, and wherein said molding compound is formed within said gap.

3. The gaming chip as set forth in claim 1, further comprising:

a plurality of insert elements positioned about said outer peripheral edge of said core element, each said insert element having a face with an opening therethrough; and said molding compound formed within said opening in each said insert element, wherein said molding compound within each said opening is visible at the exterior of said gaming chip.

4. The gaming chip as set forth in claim 1, wherein said gaming chip has an outer peripheral edge surface, and said face of said insert element comprises a part of said outer peripheral edge surface of said gaming chip.

5. The gaming chip as set forth in claim 1 wherein said insert element is connected to said core element, and wherein at least one of said insert element and said core element has means for permitting said insert element to be positioned on said core element in a single orientation.

6. The gaming chip as set forth in claim 1 wherein at least one of said core element and said insert element includes a connector for connecting said core element and said insert element.

7. The gaming chip as set forth in claim 1 wherein said molding compound is a first color, said insert element is a second color and said core element has first and second outer surfaces, at least one of said outer surfaces having raised projections thereon extending to an outer surface of said gaming chip, said core element being a third color.

8. The gaming chip as set forth in claim 1 wherein said opening includes at least one visual characteristic selected from the group consisting of a letter, a number, a casino identifier, and a gaming chip value.

9. The gaming chip as set forth in claim 1 wherein said insert element is comprised of thermoplastic molding compound including fluorescent.

10. A process for fabricating a gaming chip, said process comprising:

providing a rigid core element having an outer peripheral edge;

locating a rigid insert element, having an opening therein, proximate said outer peripheral edge of said core element;

after said locating step, forming thermoplastic molding compound around said core element and within said opening of said insert element, thereby permanently locking said core element and said insert element together.

11. The process of claim 10 wherein said locating step includes locating said opening in a position such that said molding compound formed therein is visible at said outer peripheral edge of said core element.

12. The process of claim 10 wherein said providing step further includes providing a substantially flat core element having an outer peripheral edge surface extending between first and second facial surfaces, said locating step further comprises said insert element having a face in which said opening is fixed and locating said insert element in a position such that said face and said opening therein are spacially removed from said outer peripheral edge surface of said core element, and said forming step further comprising forming molding compound between said face of said insert element and said outer peripheral edge surface of said core element.

13. The process of claim 10, wherein said gaming chip has an outer peripheral edge surface extending between facial surfaces, said locating step further comprising locating said opening at said outer peripheral edge surface of said gaming chip.

14. A product fabricated by the process of claim 10.

15. A gaming chip comprising:

a core element comprising a substantially flat disc having first and second faces lying in parallel planes and an outer peripheral edge, wherein said core element has at least one mounting post extending outwardly from its said peripheral edge;

an insert element, positioned proximate said outer peripheral edge of said core element, said insert element having a face with an opening therethrough, wherein at least one mounting post engages with said insert element; and molding compound formed around said core element and within said opening in said face of said insert element, wherein said molding compound within said opening is visible at the exterior of said gaming chip.

16. The gaming chip as set forth in claim 15 wherein said mounting post has a portion intersecting at least one of said planes, and wherein said insert element has wall portions extending therefrom, wherein said mounting post is received between said wall portions.

17. The gaming chip as set forth in claim 16 wherein one of said mounting post and a said wall portion of said insert element has a notch and the other of said mounting post and a said wall portion of said insert element has a rib, said notch and said rib adapted to mate with each other.

18. The gaming chip as set forth in claim 16 wherein said face of said insert element has an inner surface having a recessed area therein for receiving said mounting post.

19. The gaming chip as set forth in claim 16 comprising a plurality of said mounting posts, each said mounting post positioned in an indented area at said outer peripheral edge of said core element.

* * * * *